US006167878B1

(12) United States Patent
Nickerson et al.

(10) Patent No.: US 6,167,878 B1
(45) Date of Patent: Jan. 2, 2001

(54) PNEUMATIC BALL TOSSING DEVICE

(75) Inventors: Andrew S. Nickerson, Box 24 Arcadia; Frank Saulnier, Box 88 Arcadia, both of Nova Scotia (CA), B0W 1B0; Blair Cottreau, Yarmouth; Stanley Ellis, Cedar Lk., both of (CA)

(73) Assignees: Andrew S. Nickerson; Frank Saulnier, both of (CA)

( * ) Notice: Under 35 U.S.C. 154(b), the term of this patent shall be extended for 0 days.

(21) Appl. No.: 09/232,228

(22) Filed: Jan. 19, 1999

(30) Foreign Application Priority Data

Oct. 19, 1998 (CA) ..... 2250647

(51) Int. Cl.[7] ..... F41B 11/26

(52) U.S. Cl. ..... 124/64; 24/56; 24/60; 24/63; 24/65

(58) Field of Search ..... 124/56, 60, 63–65

(56) References Cited

U.S. PATENT DOCUMENTS 3,838,676 * 10/1974 Kahelin .
3,856,300 12/1974 Payne .
3,989,027 * 11/1976 Kahelin .
4,185,824 * 1/1980 Natwick .
4,244,224 * 1/1981 Conn .
4,282,848 8/1981 Kulesza et al. .
4,669,444 6/1987 Whitfeild et al. .
5,292,119 * 3/1994 Norcross .
5,294,109 3/1994 Meade .
5,496,025 * 3/1996 Phillips et al. .
5,647,338 * 7/1997 Martin .
5,733,209 * 3/1998 McIntyre, IV .
5,735,256 * 4/1998 Monk .
5,743,246 * 4/1998 Mattern .

FOREIGN PATENT DOCUMENTS

880009 * 10/1964 (GB) ..... 124/72

* cited by examiner

*Primary Examiner*—Michael J. Carone
*Assistant Examiner*—Daniel Beitey
(74) *Attorney, Agent, or Firm*—Nixon & Vanderhye P.C.

(57) ABSTRACT

A ball tossing device for batting practice comprises a self-contained, pneumatically controlled and actuated mechanism. The device includes a launcher comprising a pneumatic cylinder and ball carrier and a trough type feeder for sequentially supplying balls to the carrier for tossing. The pneumatic cylinder is actuated by compressed air from a regulated source of compressed air, with timer means which controls actuation of a valve to transmit the compressed air to the cylinder. The cylinder is a single action type with a return spring. The launcher may be angularly variable for non-vertical tosses.

13 Claims, 5 Drawing Sheets

PNEUMATIC BALL TOSSING DEVICE

FIELD OF THE INVENTION

The present invention relates to a tossing device for objects such as balls used in games and athletic sports. The device of the present invention is particularly adapted to sports or games where a moving airborne object such as a ball must be struck in the air. Such a device has particular application to practice for ball sports such as baseball, softball and tennis where repeated swinging is desirable in order for a player to develop a consistent, controlled and accurate swinging style and coordination.

The present invention provides a propulsion means for successively launching (i.e. pitching or tossing) objects such as baseballs to a consistent height and position suitable for enabling a player to practice the appropriate swing. Furthermore, the device includes a magazine and feeder for holding multiple balls and timing means for sequential timed launching of each ball. As well, the invention permits variation of the trajectory of the tossed ball, both in angle and height.

BACKGROUND OF THE INVENTION

Many sports, most notably baseball, softball and tennis, involve the striking of a ball in the air. In order for the participant to gain appropriate skill it is necessary to achieve the needed biomechanics. It has long been recognized by players and their coaches that practice is required in order to fully develop the skills of the participant. This is achieved by repetition of the physical motions required. Pitching machines and the like offer the improvement of reaction time but lack the ability to allow the athlete to perfect the physical motion at a comfortable speed.

In baseball and softball a player typically only bats three or four times in a game and may swing only two or three times at bat. Clearly this is insufficient to provide much training, but when at bat it is crucial that the player hit the ball. There is also the lack of a convenient way to "warm up" the swing before or during a game.

The baseball or softball swing contains the same basic elements of a golf swing except the backstroke. There is an initiation of the swing, a power phase and a follow through. The swing starts with the weight on the rear foot (power leg) with the belt buckle at 90 degrees to the direction to the pitched ball and then moves through a rotation of the hips and ends with a follow through. At the end of the swing the belt buckle faces where the pitcher would be. A pitched ball (either from a pitcher or a pitching machine) comes so fast that the batter must react too quickly to develop proper mechanics. Ideally the batter would apply the same swing principles to both low and high pitches. Common problems are high front shoulder causing other body adjustments in order to acquire a level swing, improper weigh transfer and faulty follow through. The answer to the coaching problem is to slow the movements to the point where concentration can be on proper technique and not simply being able to contact the ball. This gives the players an incentive to apply the proper swing mechanics.

The usual method of addressing this coaching problem is by the use of a batting tee. Such a device simply holds a ball in a fixed position and the player swings through to hit the ball. Most players find this boring. Additionally, the necessity of having to manually place the next ball on the tee is tedious and distracts the batter from concentration on the swing.

A common alternate exercise is to have another person toss the ball to the batter or player. In minor leagues, the person tossing the ball will normally kneel to one side of and facing the batter (i.e. 90 degrees to the direction of a pitched ball) and gently toss the ball to a position where the batter can strike the ball easily. This requires two people and is uninteresting for the person tossing the ball. Often the person tossing is the coach who is then not in an optimal position to see what corrections need to be made in the motion of the player and this activity is time consuming for the coach. The other disadvantage is that the throws are inconsistent when tossed by a human being.

Professional level baseball players use the batting tee and perform a practice similar to the tossing exercise described both at practices and before games. In that case the toss originates 15 to 20 feet in front of the batter along a line from the pitchers mound to home plate.

PRIOR ART

Prior devices have long sought to provide the opportunity of batting practice. Batting tees are well known and sold by many manufacturers. Additionally, mechanical devices, such as that disclosed in U.S. Pat. No. 4,282,848 to Kulesza et al. provide a spring loaded, dampened, lever actuated striker which is capable of impacting generally centrally on a ball to impel it to a height imparted by the particular spring tension. However, this device must be actuated individually for each ball tossed. The device cannot vary the height, or angle of toss in a consistent manner, but does lid produce a somewhat erratic angle of toss depending upon the point of contact of the striker against the ball.

U.S. Pat. No. 4,294,109 to Meade discloses an electric solenoid driven device, including a feeder for multiple balls. Although capable of relatively consistent height of toss, this is not capable of angular variation. Further, it requires a separate electric power source for its timing circuit.

The device of the present invention provides a ball tossing apparatus which overcomes the limitations of these prior devices. The present device provides a light, portable, easily operated pneumatic machine which is capable of consistent and repeated tossing, in sequence, of a series of balls, to the same selected height and angle of offset. The self-timing features of the device permit a single player to maintain position and attitude toward the device, and thereby ensuring greater control of repetition and consistency in the practice swing, and also avoiding the loss of concentration which results when individual actuation of each ball tossing cycle is required. Further, in the present device a feeder and magazine is capable of sequentially feeding a series of balls, in a selectively timed sequence, to the tossing mechanism which controls both power and angle of thrust such that repeated positioning of sequential balls in the same trajectory is obtained.

SUMMARY OF THE INVENTION

The desirable features of the pneumatic ball tossing device of the present invention result from the following components. The launch mechanism is angularly adjustable through a vertical angle of 45°, permitting variation from a vertical toss to lit more lateral toss. A gravity fed tube or rack is capable of feeding a series of balls sequentially to the carrier portion of a launch mechanism. The launch mechanism comprises pneumatic cylinder and piston with a ball carrier on top. The piston is operated by a source of compressed air, such as a self contained compressed air tank or "air pig", or alternatively a portable compressor. Regulated, pressurized air is controlled by a timer and fed through a valve to the launch cylinder. When the timer opens the valve, air pressure propels the piston and the carrier with a ball upwardly to launch the ball. The selected inclination of the launch cylinder and the selected air pressure determine the height and distance of the toss.

BRIEF DESCRIPTION OF THE DRAWINGS

A better understanding of the present invention will be obtained from a reading of the following description in conjunction with the drawings, in which:

Referring to FIG. 1 where the present invention is illustrated in relation to a baseball tossing machine, the device comprises a self-contained unit having a base 10, and end frame 12 as well as an enclosure or housing (not illustrated). A launcher cradle 14 is pivotally connected to the end wall to support a launch mechanism 16. Vertical support brackets 18 and 20 hold feeder tube 22 at an inclination angle of approximately 20 degrees to provide a slope for gravity feed of baseballs 24 (see FIG. 2). The feeder tube may also have an extender tube 22' as shown in phantom in FIG. 2. This extender tube 22' co-operates with tube 22 to serve as a magazine to permit additional ball storage.

Figure 1:
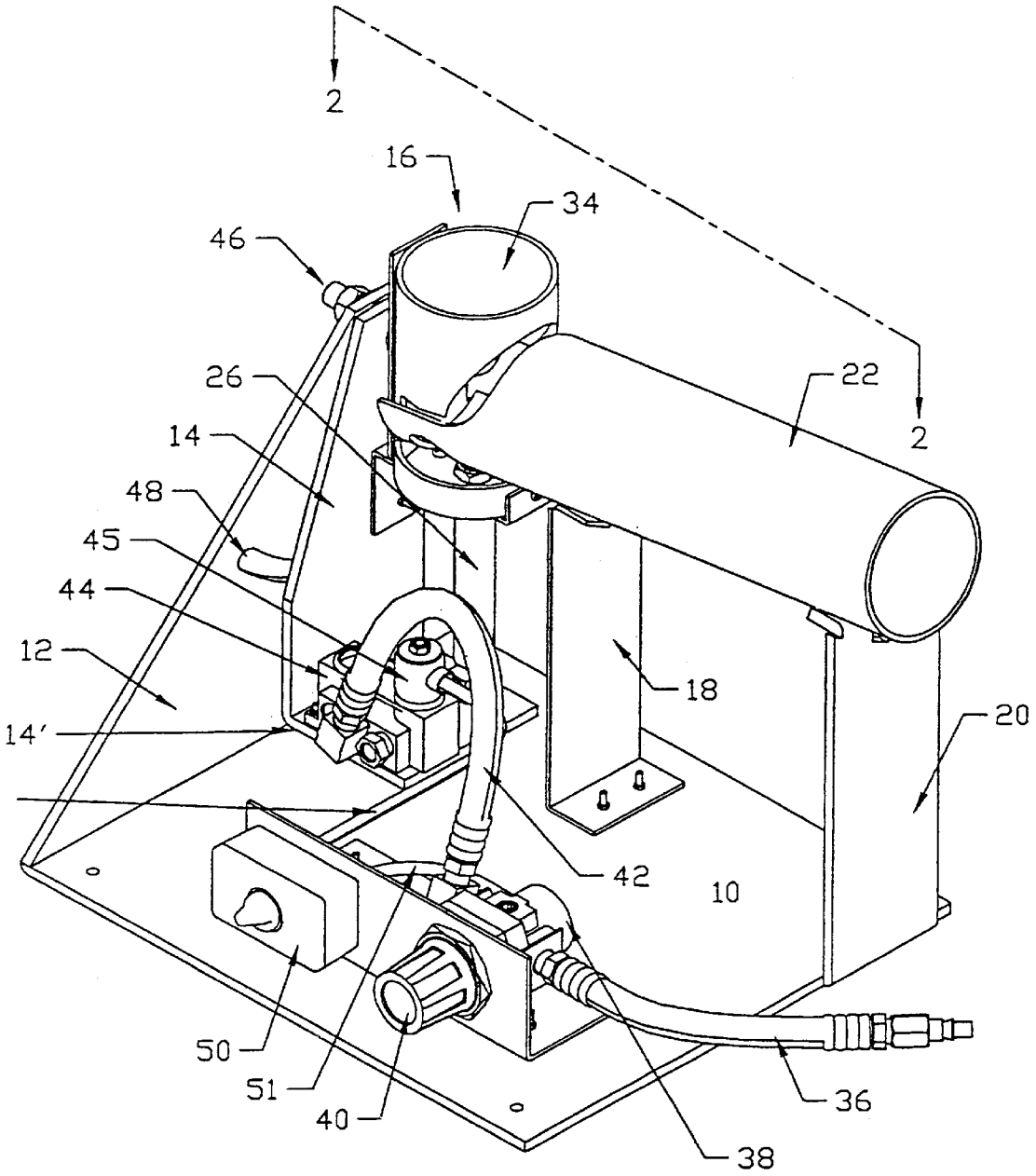
FIG. 1 is a perspective view of the device of the present invention.
Figure 2:
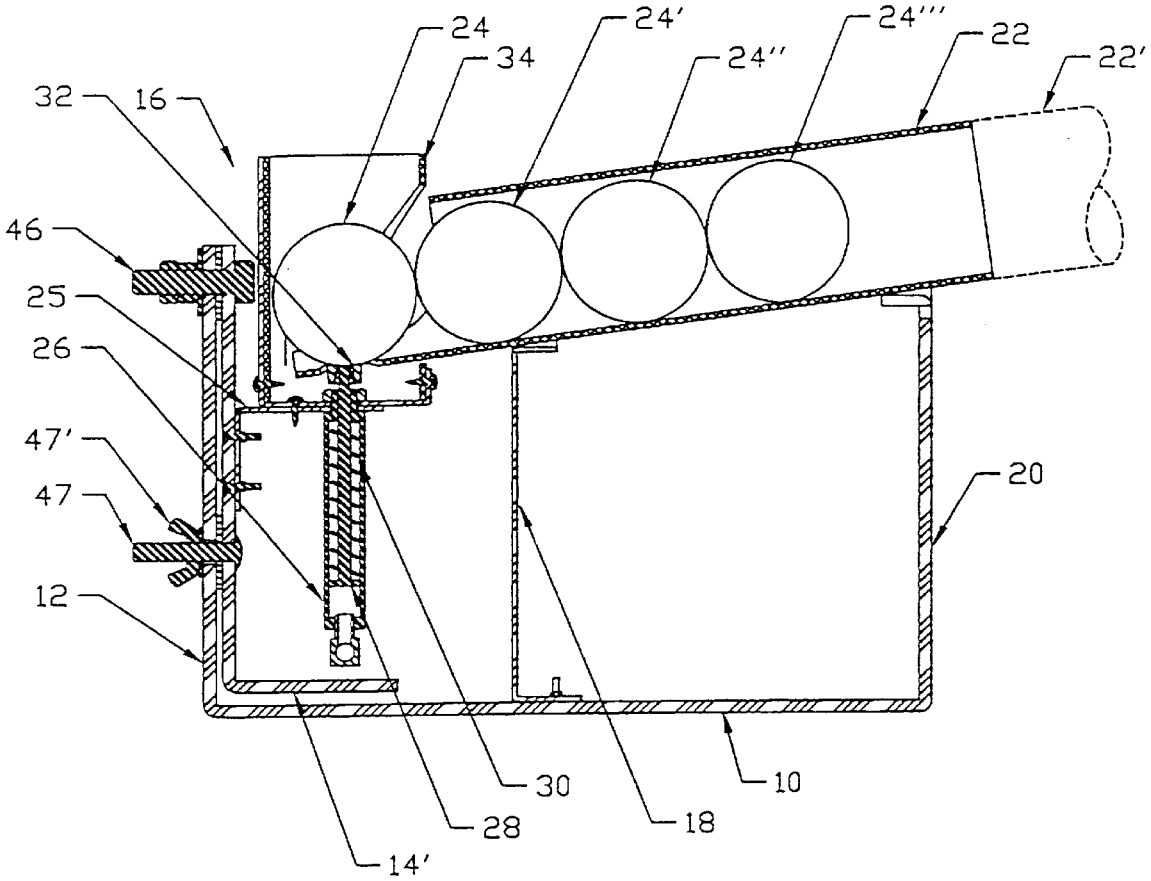
FIG. 2 is a vertical section through the device of FIG. 1 at 2—2.

Balls 24 are sequentially tossed by a launch mechanism 16, which is mounted on an intermediate bracket 25 extending laterally from cradle 14, and comprises an air actuated cylinder 26 with central piston and rod 28. The pneumatic cylinder 26 is a single acting push type cylinder with a spring return 30.

Piston rod 28 extends through the cylinder casing 26 and terminates at a ball striker 32, adapted to contact a ball in the launch mechanism. Each ball 24 is sequentially positioned for launching in a cylindrical exit tube 34, which loosely surrounds and stabilizes the ball, particularly useful when the launch mechanism is inclined as explained hereafter. Ball 24 is supported in the launch position by a lower launching lip of tube 22. An aperture or slot in the lip permits striker 32 to impact the underside of ball 24.

The air supply for cylinder 26 comes from an air reservoir, such as a compressed air tank or "air-pig", compressor or similar device (not shown), via air supply hose 36. A shut-off valve may be provided on the tank and a quick-connect coupling attaches the tank to supply hose 36. Pressurized air is fed via hose 36 to regulator 38 which regulates the pressure of air fed to the cylinder 26 by means of control knob 40. Alternatively, a small air tank may be mounted directly onto the base 10, within the structure of the device. The air is fed from regulator 38 by a flexible hose 42 to a three-way air valve 44 which is mounted on a horizontally extending leg 14' of cradle 14. The hose 42 flexes to permit angular adjustment of cradle 14. Valve 44 preferably is actuated by an air pilot device but may be actuated by an electric solenoid if electric support is available or preferred. The air pilot device 45 is mounted to and integral with valve 44. When actuated, valve 44 feeds pressurized air to the base of pneumatic cylinder 26 causing rapid extension of the piston rod 29, and propulsion of the ball 24 from the tube 34. After ejection of the ball, valve 44 is closed by the air pilot 45 and spring 30 of the air cylinder 26 returns the piston 28 to its inactive or downward position while the air in the cylinder is exhausted by three-way valve 44. Valve 44 is actuated by a trigger means, which may be a pneumatic timer, or an electric solenoid operated by a variable timer, or even an independent hand control operated by a batting coach.

The three-way air valve 44 is mounted on cradle leg 14' while the cylinder 26 and ball carrier 32 are mounted on bracket 25. The foregoing items are all connected on cradle 14 into an integral launch unit 16. Cradle 14 is pivotable about upper pivot bolt 46 which connects the cradle 14 to end frame 12. A slide adjustment stud 47 and thumb screw 47' are mounted through the cradle 14, and slide in arcuate slot 48 to adjust the cradle to a selected angular position. When cradle 14 is pivoted about bolt 46, the inclination of the launch mechanism 16 is varied to permit the launcher to operate at a non-vertical angle. A three-way air valve 44, such as Mead-Dyla-Trol® valves, will perform adequately in this role. The valve 44 is activated by air pilot 45 such as a Mead Nova N2-DP which is triggered by an air timer 50.

Figure 3:
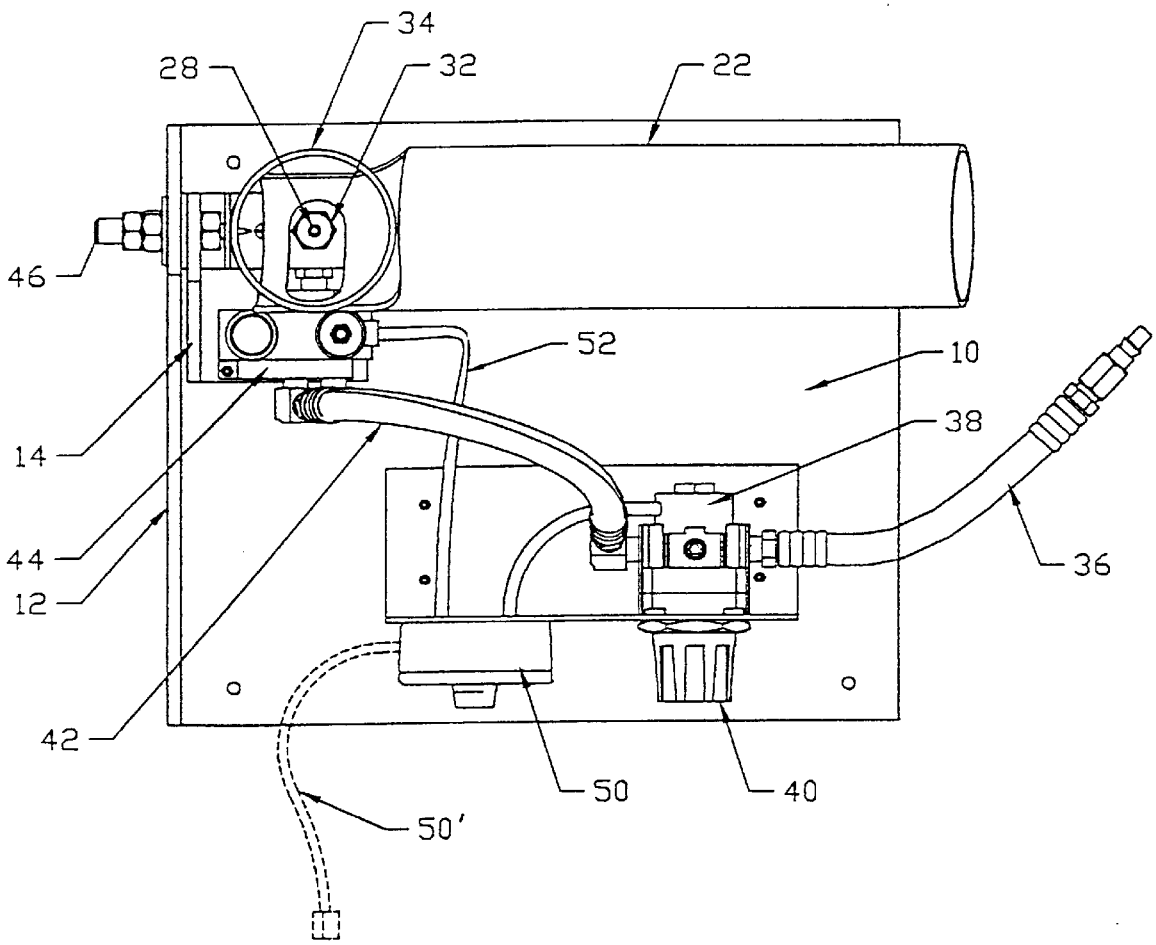
FIG. 3 is a plan view of the device of the present invention.
Figure 4:
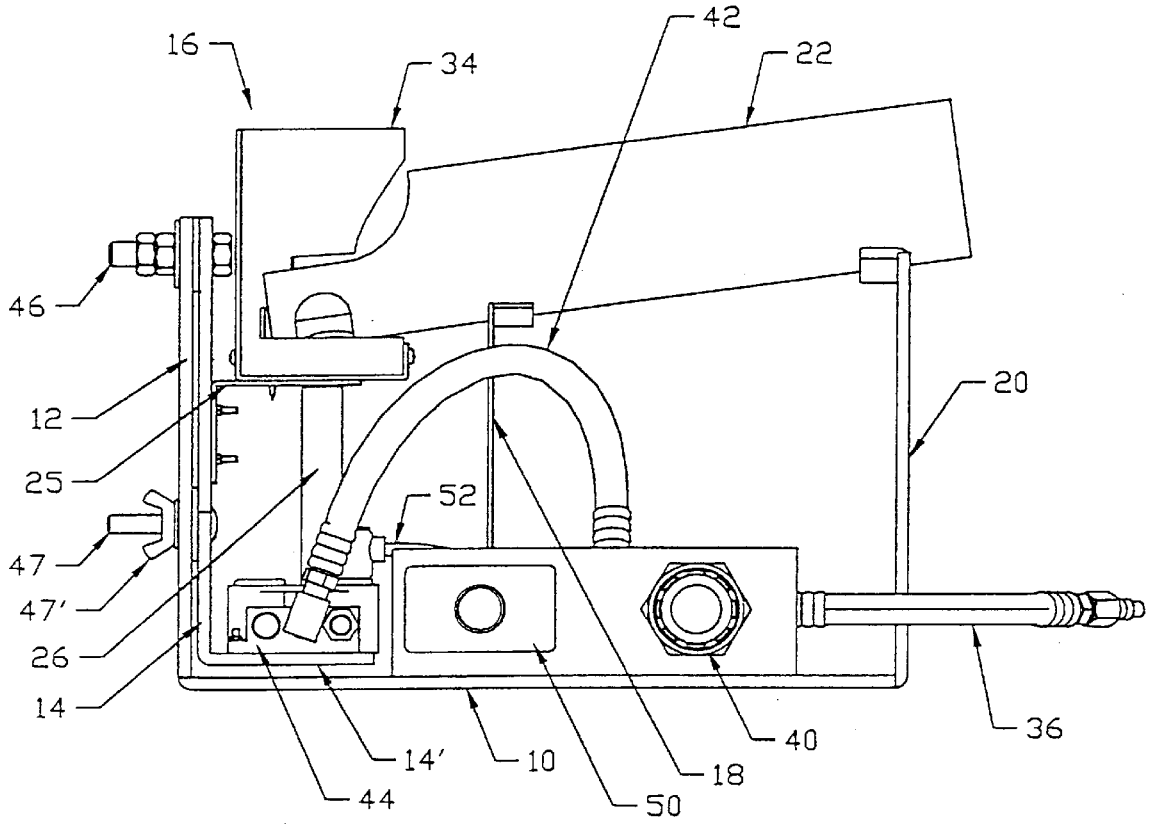
FIG. 4 is a vertical side elevation of the device.
Figure 5:
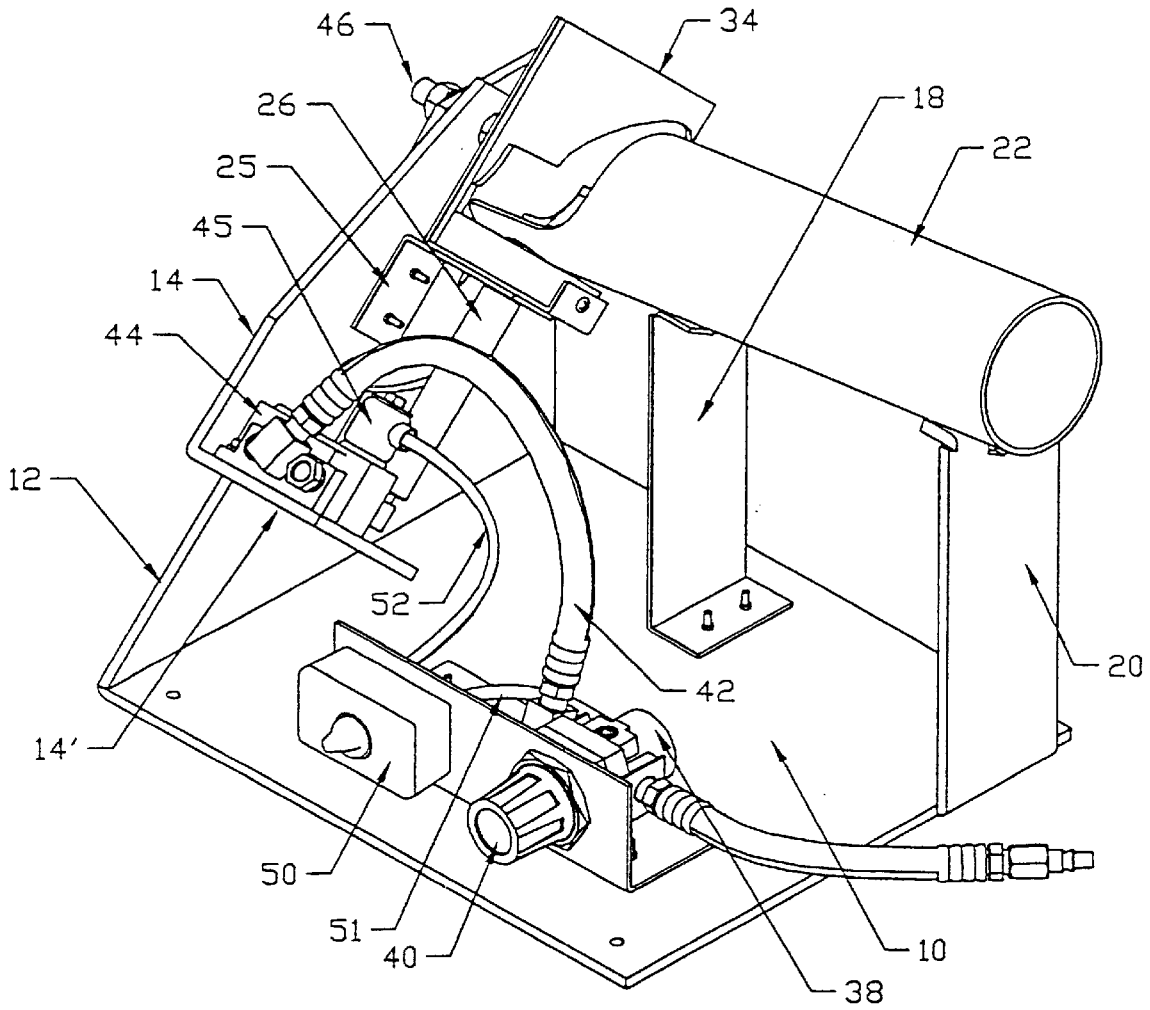
FIG. 5 is a perspective view of the device, with the launch mechanism inclined at 45 degrees.

A timer 50 may be employed to activate the air pilot 45 and valve 44, and to control the delay between each activation cycle. The timer may be electric (as illustrated in FIG. 3 at 50', in phantom) or preferably it may be a pneumatic or air timer 50 operated via air supply hose 51. The pneumatic timer may have a variable adjustment to change the interval between activation cycles. At set intervals the pneumatic timer 50 feeds pressurized air, via hose 52, to the inlet of air pilot 45 to activate three-way valve 44.

Although a high pressure air supply can be used, which would enable the use of a smaller sized container vessel, pressure vessel restrictions and regulations in some jurisdictions require that a lower pressure compressed air tank or "air-pig" be used. It has been found that a small pressure vessel such as a 5 gallon tank, which can be pressurized to 125 psi or higher at a service station, will supply sufficient air for over 800 activation cycles, when operating on a three-quarter inch diameter pneumatic cylinder with a two inch stroke. If the pressure regulator is set for 50 psi, approximately 850 cycles can be obtained, whereas an 80 psi regulator setting will produce a higher toss for up to 480 cycles. Alternatively the pressure vessel could be filled on site, either from a 110 volt compressor or a compressor operated from the 12 volt outlet of an automobile.

The tossing device disclosed herein is low to the ground, having a height of less than eighteen inches. Its base 10 is approximately eighteen inches by twelve inches. It has the ability to toss a ball vertically to a height from the ground of between 1.5 feet and 5 feet, and has a feeder capacity sufficient to toss in sequence approximately 24 balls. If combined with a net and a system for returning the balls to the machine, it can achieve virtually continuous use.

In operation, the tossing device of the present invention is set on he ground adjacent a batting area. Balls (up to 24 balls if feeder tube extensions are used) are loaded into the feeder, the air pressure supply is connected and the regulator set for a predetermined pressure, depending upon the height to which the ball is to be tossed. As well, the angle of toss is set for the launching mechanism by rotation of the launch cradle 14 about pivot pin 46, and the cradle is fixed in the selected position by tightening thumb screw 47' against arcuate slot 48. The timing interval is then set on pneumatic timer 50 (or its electric counterpart with power cord shown in phantom). The air supply is attached to the supply take 36 by a quick connected coupling. The piston will be activated via the timer and opening of the 3-way valve, thereby launching a first ball to the preset height and distance. Upon retraction of the piston rod and carrier under the action of the return spring, the next ball in the feeder rolls, by gravitational force, into the firing position for the next cycle.

Although the preferred embodiment described above discloses the use of an air timer, an air pilot and a three-way valve in combination, a further embodiment may utilize a refinement of these components into a piloted 5-port, 4-way, 2-position valve where the timer feature is included in the composite valve and pilot body. A suitable 4-way valve is manufactured by Numatics Inc. of Highland, Mich. It has been found that a variable micro-pneumatic valve such as manufactured by Clippard or Camozzi, in combination with a suitably sized pressure reservoir which acts as a timing means is effective for adjustment of the frequency of tosses.

The ability to control the height of the toss is a great advantage. This will allow the batter to hit the ball at different heights and will allow the batter to strike the ball at nearly the same spot in reference to the length of the bat on each swing. The toss exercise where the ball is tossed from a direction 90 degrees from the line between home and the mound will invariably cause the batter to hit at different spots along the length of the bat. Batters refer to a "sweet spot" on the barrel of the bat. With the vertical trajectories achieved the present device, the batter can more easily determine this area on the bat where contact is best.

One of the great advantages of the present design is that there is complete control and complete consistency in the height of the toss.

Although the above described embodiment of the invention has been constructed primarily for tossing baseballs, it is contemplated that with suitable modifications, the same general principles would apply to tossing of other ball types, such as tennis balls. Additionally, although a completely self contained apparatus is preferred, larger separate air supply tanks could be used or electric timers and solenoids used for valve operation rather then the preferred pneumatic devices.

Other modifications and variations will be apparent to those skilled in this particular art after reviewing the present specification. The invention therefore is not to be limited to the specific details of construction described herein, but shall include the equivalents of the means disclosed herein and for definitions of the invention reference is to be had to the appended claims.

What is claimed is:

1. A portable pneumatic ball tossing device adapted for upward tossing of a ball for use in swing development, comprising:

a base;

a launch mechanism connected to said base, said launch mechanism including a pneumatic cylinder and piston rod adapted to contact and propel the ball;

feeder means for holding and feeding one or more balls to the launch mechanism;

a supply of compressed air;

valve means for selectively passing compressed air from said supply to said launch mechanism; and trigger means for controlling operation of said valve means.

2. The ball tossing device of claim 1 wherein the trigger means is a manually operated pneumatic switch, or a pneumatic timer.

3. The ball tossing device of claim 1 wherein the pneumatic cylinder is a single action push type with a return spring.

4. The ball tossing device of claim 1 wherein the axis of the launch mechanism can be inclined from the vertical.

5. The ball tossing device of claim 1 wherein the launch mechanism and the valve means are mounted on a pivotable cradle connected to the base.

6. The ball tossing device of claim 1 wherein the valve means is controlled by an air pilot control valve.

7. The ball tossing device of claim 1 wherein the feeder means is an inclined tube.

8. The ball tossing device of claim 1 wherein the valve means is a three-way valve, with an air pilot control valve and the trigger means is an pneumatic timer.

9. The device of claim 1 wherein the valve means is a three-way valve with an electric solenoid control valve and an electric timer.

10. The device of claim 1 wherein the valve means is a three-way valve with a manual pneumatic switch actuator.

11. The device of claim 1 wherein the supply of compressed air is a regulated pressure vessel.

12. A portable pneumatic ball tossing device adapted for upward tossing of a ball for use in swing development comprising a base and housing, a launch mechanism and valve means mounted on a cradle, the cradle being pivotable about a horizontal axis from the vertical to a selected vertical angle, and a tubular inclined feeder, wherein:

the launch mechanism is a vertically orientable pneumatic cylinder of the singe acting push type with a return spring;

the valve means comprises a three-way valve adapted to feed regulated compressed air from a supply, to the pneumatic cylinder for movement of the piston rod; and the valve is actuated by an air pilot activated by a pneumatic trigger.

13. The device of claim 12 wherein the pneumatic trigger means is a manually operated pneumatic switch, or a pneumatic timer.

* * * * *